United States Patent [19]

DiBiagio

[11] Patent Number: 5,012,707

[45] Date of Patent: May 7, 1991

[54] AWNING SPRING WINDER

[75] Inventor: Anthony J. DiBiagio, Granger, Ind.

[73] Assignee: Holiday Rambler Corporation, Wakarusa, Ind.

[21] Appl. No.: 302,430

[22] Filed: Jan. 27, 1989

[51] Int. Cl.[5] ..... B25B 13/02

[52] U.S. Cl. ..... 81/124.2; 81/124.3

[58] Field of Search ..... 81/124.2, 124.3, 176.1, 81/176.15

[56] References Cited

U.S. PATENT DOCUMENTS

| | | | |
|---|---|---|---|
| 107,255 | 9/1870 | Harris | 81/124.2 |
| 671,789 | 4/1901 | Borgeson | 81/124.3 |
| 2,987,080 | 6/1961 | Chandler et al. | 81/124.2 |
| 3,228,269 | 1/1966 | Heyer | 81/124.2 |
| 4,749,251 | 6/1988 | Moulin | 81/124.2 |

*Primary Examiner*—Frederick R. Schmidt
*Assistant Examiner*—Lawrence Cruz

[57] ABSTRACT

A hand tool for winding awning springs is provided. The tool includes an elongate hollow sleeve having an elongate handle member perpendicularly joined to the sleeve and having two handle arms angularly disposed at one end of the sleeve. The hollow sleeve is slotted to define a spring chamber which receives a predetermined length of an awning spring therein. At the end of the winder opposite the handle member is a recessed slot which terminates in a circumferential notch adapted to engage an awning spring leg. A stop member affixed to the handle member and in a sliding relationship therewith, slides along the handle member into the spring chamber to engage the awning spring.

12 Claims, 2 Drawing Sheets

AWNING SPRING WINDER

BACKGROUND AND SUMMARY OF THE INVENTION

The present invention relates generally to tools for winding springs and more particularly to a hand held tool for winding and tensioning awning springs used to tension recreational vehicle extendable awnings.

Extendable awnings are commonly used on recreational vehicles. Typically, these awnings are held between two awning posts attached to the vehicle side and include cloth, vinyl or metallic awning fabrics which extend between a fixed point near the top of the vehicle side down and an awning scroll. When assembled, the awning is extendable between a retracted position, where the awning and scroll are held close to the side of the vehicle, and an extended or open position, where the awning extends outwardly from the vehicle. The tubular metal scroll at the lower end of the awning cloth typically contains at least awning springs to provide a wind-up mechanism for the awning. These awning springs may extend longitudinally within the awning scroll for a predetermined length of between one-half and the entire length of the scroll.

In order to provide the required retraction characteristics, the awning spring must be circularly wound to tension the spring prior to its insertion into the scroll. Previously, ordinary adjustable wrenches were used to grip an end of the awning spring and turn it to provide the desired tension. This method is undesirable and potentially unsafe in that the possibility exists that the wrench can slip off the end of the awning spring. Also, since adjustable wrenches typically have only one handle and not two, it is difficult to comfortably grab the wrench to properly turn the spring to apply the desired amount of spring turns.

The present invention is directed to a hand-held winding tool which makes the winding of awning springs much safer in that it firmly engages one end of an awning spring and prevents the rotation thereof and which easily allows the user to apply the desired number of turns to the awning spring to attain a desired tension level. Gripping handles which extend outwardly from the tool allow an operator to grip it with both hands and easily turn the awning spring. An engagement notch in the tool engages the awning spring end and restrains the spring from rotating relative to the tool during winding. The engagement notch is recessed in the tool body to prevent the spring from freeing itself from the tool.

In an awning spring winder incorporating the principles of the present invention, an elongate hollow spring chamber is provided with a handle member at one end having two elongate handles which extend radially outward from the chamber to provide hand grips for spring rotation. The spring chamber includes a longitudinal slot disposed along a first longitudinal axis of the tool, and a recessed notch disposed along a second longitudinal axis of the tool generally opposite the longiudinal slot to provide the tool with means for engaging the awning spring and restraining it from movement relative to the tool. A moveable stop member is disposed on the handle member which is moveable along the handle between a first spring loading position and a second position radially inward of the spring chamber to an awning spring securement position.

Accordingly, it is a general object of the present invention to provide an improved awning spring winder having a hollow elongate slotted chamber which is adapted to receive a predetermined length of an awning spring therein, the chamber having means for restraining rotation of the spring relative to the winder, the chamber further having a pair of winding handles extending radially outwardly from the chamber.

It is another object of the present invention to provide an improved awning spring winding tool for tensioning recreational vehicle awning springs in which the tool includes a hollow spring engagement chamber which receives a longitudinal extent of the awning spring through a slot disposed along a tool first axis and in which the spring engagement chamber includes a recessed notch adapted to receive an awning spring end, the notch being disposed along a second tool axis generally parallel to the first.

It is yet another object of the present invention to provide an awning spring winder having two outward handles extending perpendicular to a winder barrel portion which provide handles a gripping surface on the tool for rotating the awning spring, one of the handles having a moving spring loading moveable along the handle between a first spring winding position and a second spring securement position, the stop member including a spring engagement surface thereon which engages a portion of the periphery of the spring.

These and other objects, features and advantages of the present invention will be clearly understood through a consideration of the following detailed description.

BRIEF DESCRIPTION OF THE DRAWINGS

In the course of this description reference will be made to the attached drawings, in which.

DETAILED DESCRIPTION OF THE INVENTION

Figure 1:
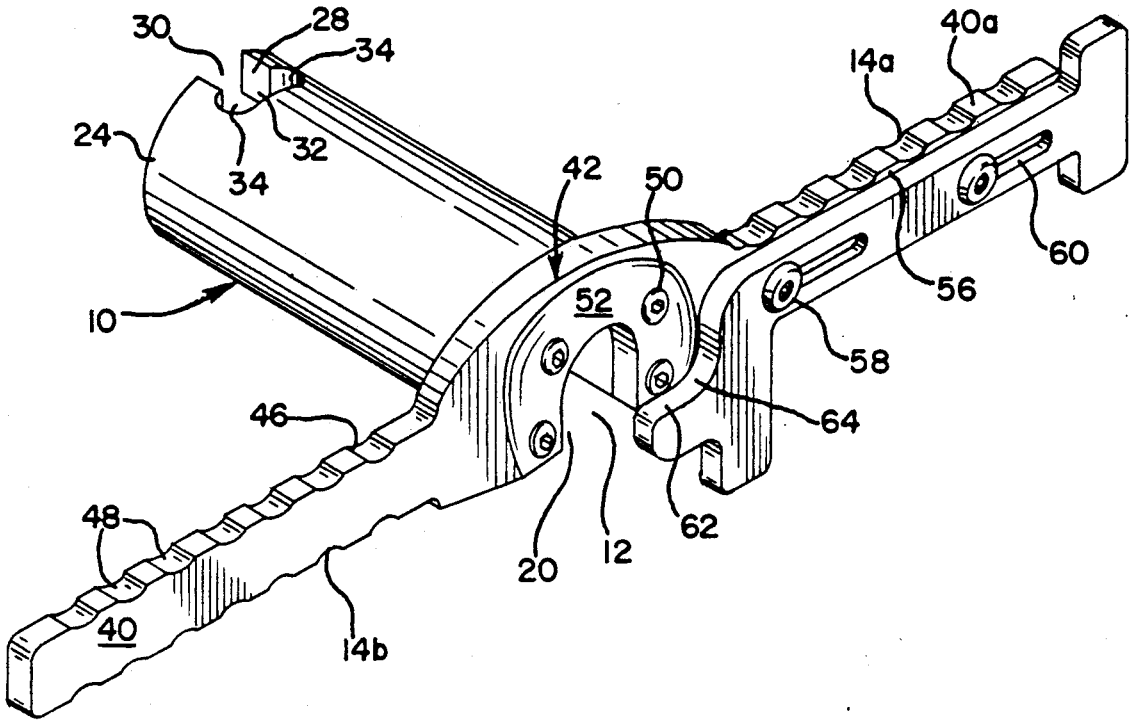
FIG. 1, is a perspective view of an awning spring winder embodying the principles of the present invention.
Figure 2:
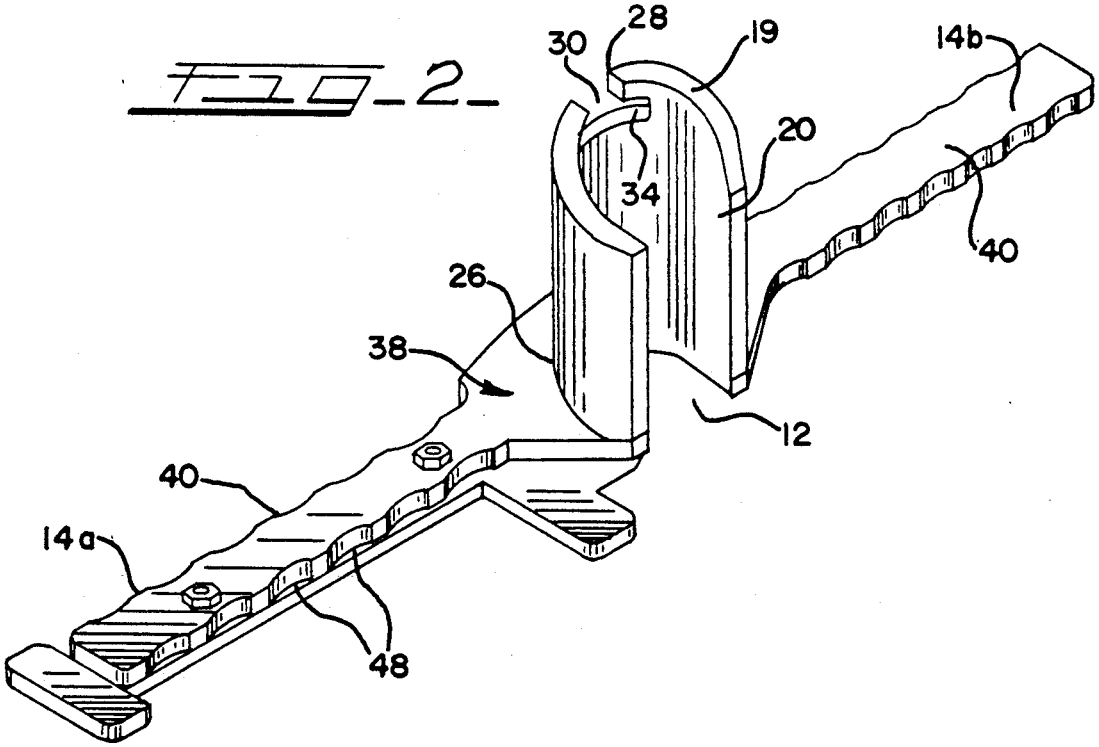
FIG. 2 is a perspective view of the awning spring winder of FIG. 1 inverted to show the spring chamber.

Referring now to the drawings, and in particular to FIGS. 1 and 2, a hand-held awning spring winder, generally designated as 10, constructed in accordance with the principles of the present invention is shown as having a spring chamber 12 and two outwardly extending handles 14*a* and 14*b*. The spring chamber 12 includes a elongate hollow sleeve 16 of a predetermined length and has a generally circular cross-sectional configuration. The predetermined length of the chamber is preferably sufficient to cover a similar length of an awning spring 18. The sleeve 16 has a entry slot 20 therein which extends longitudinally in the sleeve wall 19 between the two opposite ends 24 and 26 of the winder 10.

Means for engaging an awning spring lug or spider 17 typically located at the end 27 of the awning spring 18 is provided in the form of a small longitudinal slot 28 which forms a recess 30 in the sleeve wall 19 at the one end 24 of the spring winder. The recess 30 opens at its inner end 31 into a small circumferential notch 32 positioned generally perpendicular to the recess 30 extending along a predetermined arc length in the winder sleeve wall 19 to define a generally T-shaped opening. At the opposite ends of the notch 32, and set back from the recess 30 are two openings 34 which are of sufficient size to accommodate one of the awning spring spiders 17*a*, 17*b*. The width of the recess 30 is preferably just slightly greater than the thickness of the awning spring spiders 17*a*, 17*b* so that the amount of play between the awning spring spider 17*a* and the recess 30 is held to a minimum when the winder 10 is inserted over the spring 18 and the spider 17*a* engaged with the notch 32. As will be explained in greater detail below, the notch 32 and openings 34 ensure that the awning spring 18 is firmly engaged in the spring engagement recess 30 and will not slip out.

At the opposite end 26 of the sleeve 16, an elongate handle member 38 is joined to the sleeve 16 and extends outwardly therefrom generally perpendicularly to the spring chamber 12. The handle member 38 includes two winder arms 40*a*, 40*b* having handles 14*a*, 14*b* which extend outwardly from a collar portion 42 and which are generally angularly disposed apart from each other. Preferably, the winder arms 40*a*, 40*b* are disposed approximately 180° from each other so as to provide an easy gripping surface and enable the user to easily apply the amount of torque needed to turn the spring. Each of the winder handle arms 40*a*, 40*b* preferably includes grip portions 44 having a serrated surface 46 thereon, for easy holding, such as finger depressions 48 shown in FIGS. 1–3. Although two handles are illustrated in the drawings, the winder may include only one handle.

Figure 3:
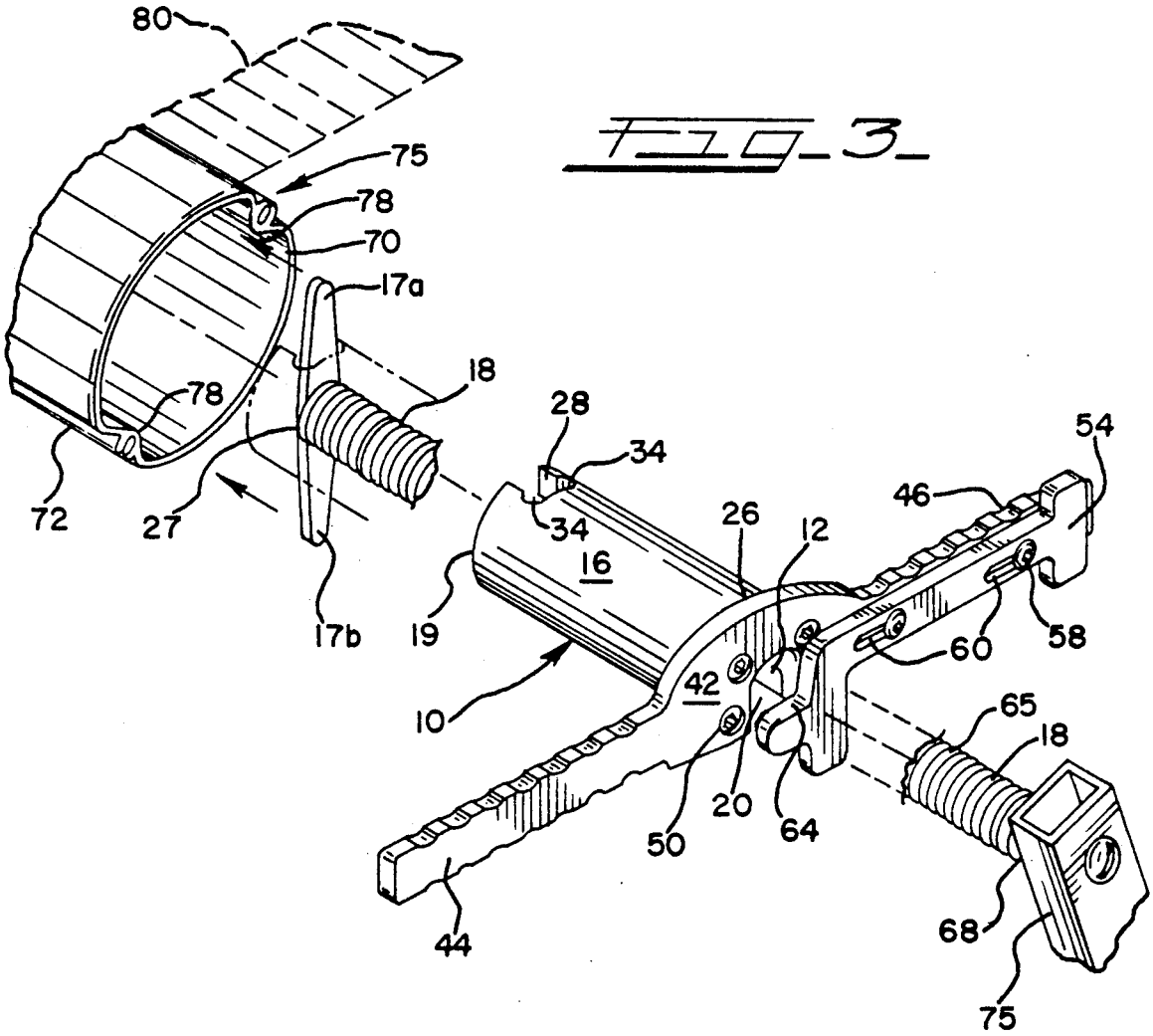
FIG. 3 is an exploded perspective view of the awning spring winder of FIG. 1 in position on an awning spring.

The handle collar 42 can be joined to the sleeve 16 by any suitable securement means such as by welding or bolts 50 as shown in FIGS. 1 & 3. Preferably, the securement means will not interfere with movement of an engaging means such as stop member 54. For example, when bolts 50 are used to attach the handle member 38 to the sleeve to the collar 42 may either include an inclined or tapered surface 52 where the collar 42 meets the sleeve inner wall 19 as shown in FIGS. 1 & 2 or the bolts 50 maybe recessed in the collar 42 as shown in FIG. 3.

With more particular reference to the stop member 54 or the like, at least one of the handle arms 40*a*, 40*b* includes means for frictionally engaging the awning spring 18. The illustrated engaging means takes the form of the elongate stop member 54 which is slideably disposed on the surface 56 of the handle arm 40*a*. The stop member 54 shown is equipped with slots 60 which engage a series of handle screws 58 so as to allow it to slide along the arm surface 56 radially inwardly of the spring chamber 12 between a first spring loading position (FIG. 1) and a second position where the stop member 54 secures engages the awning spring 18 (FIG. 3). However, the stop member 54 may also be pivotally attached to one handle arm 40*a* such that it pivots between a first spring loading position and a second spring securement position. The stop member 54 preferably has a non-linear spring engagement surface 62, shown as a generally arcuate or curved surface 64 which engages a portion of the periphery 65 of the awning spring 18 and binds it against the sleeve wall 19.

To wind the awning spring, the spring 18 is inserted into the spring chamber 12 by way of the entry slot 20. The sleeve 16 is dimensioned so that there is an adequate clearance in the spring chamber 12 between the awning spring 18 and the sleeve wall 19 so the winder is easily moved forwardly along the spring and oriented so that the awning spring spiders or lugs 17*a*, 17*b* are in line with the entry and recess slots, 20 and 30. The winder is then moved further along the spring 18 until the spider 17*a* enters the recess 30 and the spider 17*b* enters the slot 20. The winder 10 is then slightly turned so that the spider 17*a* engages either notch opening 34. The stop member 54 is moved slid along handle arm 14*a* until its engagement surface 62 engages the awning spring 18. The winder can then be grasped by the handle arms 40*a*, 40*b* and turned for the required number of turns to provide the necessary tension or torque for the awning spring 18. The T-shaped slot defined by the recess 30 and the notch openings 34 is recessed a sufficient extent so that the awning spring 18 is firmly held by the winder 10 during the winding process and substantially prevents the spring 18 from working loose. The stop member 54, when in engagement with the spring 18 assists in maintaining the poisiton of the winder 10 on the spring 18.

After the desired number of turns are given to the spring, the spring winder one end 24 is inserted into the open end 70 of the awning scroll 72 and pushed inwardly until the scroll opening 70 generally abuts the handle arms 40*a*, 40*b*, preferably, a distance of about 3 inches. The spring stop member 54 is slid back to release the awning spring 18 and the winder is then slid backward along the spring until it is clear of the awning scroll 72, and then removed via spring entry slot 20. When inserted into the awning scroll 72, the awning spring spiders 17*a*, 17*b* will engage the scroll ridges 78 to prevent the spring 18 from turning further. Since the awning spiders 17*a*, 17*b* are inserted approximately 3 inches into the awning scroll 72 prior to the winder 10 being disengaged from the spring 18, the liklihood of the spring 18 working its way back out of the scroll 72 is significantly reduced. The opposite end of the awning spring does not rotate under normal use, because it is fixed at its opposite end 68 to an awning post 75. Therefore, the tension applied to the spring by the turns will impart a torque to the awning scroll 72 which causes the scroll 72 to turn (counterclockwise in FIG. 3), thereby winding the awning fabric 80 around it when the awning 75 is retracted toward the vehicle side.

It will be appreciated that the embodiment of the present invention which has been discussed is merely illustrative of one of the applications of the principles of the invention. Numerous modifications may be made by those skilled in the art without departing from the true spirit in scope of the invention.

What is claimed is:

1. A hand tool for tensioning awning springs, comprising:

a spring chamber including an elongate hollow sleeve having a predetermined length to accommodate a predetermined length of an awning spring within the sleeve, said sleeve having a slot which extends the length of said sleeve between the sleeve ends along a first axis of said tool, the slot providing an opening in said sleeve so that said hand tool receives the awning spring predetermined length within said sleeve, one end of said sleeve having means for engaging an end of an awning spring and preventing rotation of said awning spring relative to said tool, the spring engagement means being disposed along a tool second axis generally parallel to the tool first axis, the opposite end of said sleeve including means for applying rotation to said spring which includes a winding handle radially extending generally perpendicularly from said sleeve and having gripping surfaces thereon, said winding handle including means for securing a portion of said spring.

2. The hand tool of claim 1, wherein the spring securement means includes a stop member moveable on said winding handle between a first spring loading position and a second spring securement position, the stop member including a spring engagement surface which engages a portion of the periphery of said spring and binds said spring against a portion of the wall of said sleeve, to secure said spring in said sleeve.

3. The hand tool of claim 1, wherein said spring rotating means includes two winding handles angularly disposed from each other.

4. The hand tool of claim 3, wherein said winding handles are disposed approximately 180° apart from each other.

5. The hand tool of claim 1, wherein said spring engagement means includes a recessed notch in said spring chamber sleeve, said notch being adapted to engage the end lug of an awning spring therein.

6. The hand tool of claim 1, wherein said spring engagement means includes a generally T-shaped slot disposed in the wall of said sleeve one end, the generally T-shaped slot being adapted to engage the end lug of an awning spring in said slot.

7. The hand tool of claim 5, wherein said recessed notch includes a generally T-shaped slot.

8. The hand tool of claim 2, wherein said stop member is slideably disposed on said handle and slideable along said handle between said first and second positions.

9. The hand tool of claim 3, wherein said stop member is pivotally disposed on said handle and pivotable thereon between said first and second positions.

10. A hand-held awning spring winder for winding recreational vehicle awning springs having at least one spring end which includes a spring scroll lug extending outwardly from the spring and which lug is sized to fit within an awning scroll, the awning spring winder comprising:

(A) A elongate barrel portion having a longitudinal spring receiving chamber extending the length of the barrel portion and being adapted to accommodate a pre-determined length of awning spring therein;

(B) Said barrel portion including a longitudinal slot opening into said chamber, one end of said barrel portion having means for restraining rotation of the awning spring relative to said awning spring winder, (C) The spring rotation restraining means including a longitudinal recess in a wall of said barrel portion opening into a pair of opposing notches, said notches being adapted to engage said awning spring lug, (D) Said recess being positioned in said wall of said barrel portion generally opposite said longitudinal slot, (E) Said barrel portion further including winder rotation means in the form a handle disposed at the other opposite end of said winder barrel portion and opposite of said fixed rotation means, said handle extending radially outwardly from said chamber and including a hand grip surface thereon; and (F) Said winder rotation means includes awning spring securement means in the form of a stop member moveable on said handle between a first position and a second position to secure said awning spring in said barrel portion.

11. The hand-held awning spring winder of claim 10, wherein the stop member is slideably disposed on said handle and is slideable along said handle between said first and second positions.

12. The hand-held awning spring winder of claim 10, wherein said stop member is pivotally disposed on said handle and pivots along said handle between said first and second positions.

* * * * *